United States Patent [19]

Jennings, Jr. et al.

[11] Patent Number: 5,036,917

[45] Date of Patent: Aug. 6, 1991

[54] METHOD FOR PROVIDING SOLIDS-FREE PRODUCTION FROM HEAVY OIL RESERVOIRS

[75] Inventors: Alfred R. Jennings, Jr., Plano; Roger C. Smith, Dallas, both of Tex.

[73] Assignee: Mobil Oil Corporation, Fairfax, Va.

[21] Appl. No.: 446,833

[22] Filed: Dec. 6, 1989

[51] Int. Cl.[5] ..... E21B 43/24; E21B 43/267

[52] U.S. Cl. ..... 166/263; 166/271; 166/272; 166/280; 166/297; 166/308

[58] Field of Search ..... 166/280, 281, 283, 303, 166/308, 271, 272, 274, 275, 263, 297

[56] References Cited

U.S. PATENT DOCUMENTS

| | | | |
|---|---|---|---|
| 3,259,186 | 7/1966 | Dietz . | |
| 3,280,909 | 10/1966 | Closmann et al. . | |
| 3,354,954 | 11/1967 | Buxton . | |
| 3,367,419 | 2/1968 | Van Lookeren . | |
| 3,882,941 | 5/1975 | Pelofsky | 166/263 X |
| 3,908,762 | 9/1975 | Redford | 166/263 |
| 4,067,389 | 1/1978 | Savins | 166/246 |
| 4,109,722 | 8/1978 | Widmyer et al. | 166/281 X |
| 4,109,723 | 8/1978 | Widmyer | 166/306 X |
| 4,249,604 | 2/1981 | Frazier | 166/263 |
| 4,378,845 | 4/1983 | Medlin et al. | 166/280 X |
| 4,378,849 | 4/1983 | Wilks | 166/369 |
| 4,549,608 | 10/1985 | Stowe et al. | 166/280 |
| 4,623,021 | 1/1986 | Stowe | 166/250 |
| 4,733,726 | 3/1988 | Alameddine et al. | 166/271 X |
| 4,817,717 | 4/1989 | Jennings, Jr. et al. | 166/278 |
| 4,848,468 | 7/1989 | Hazlet et al. | 166/250 X |

*Primary Examiner*—George A. Suchfield
*Attorney, Agent, or Firm*—Alexander J. McKillop; Charles J. Speciale; Charles A. Malone

[57] ABSTRACT

A method for controlling formation fines when producing heavy oil from an unconsolidated sand formation where at least two wells are utilized. Both wells are perforated and hydraulically fractured at a lower interval via a viscous gel fluid having a sized and high temperature resistant proppant therein. The proppant is a size sufficient to filter fines from the oil, thereby keeping the fracture clear. Cyclic steam-flooding and oil production are conducted in one well, while the other is shut-in. This sequence is continued until steam breaks through at the lower interval from a first well into a second well. Afterwards, production packers with knock-out plugs are used to isolate the lower interval of both wells. Cyclic steam injection and oil production are continued in the upper interval of both wells. Subsequently, both wells are shut-in and production strings are directed to the lower formation interval through the knock-out plugs. Steam is then injected down the lower level of both wells and oil is produced from the upper level through the annuli of both wells.

10 Claims, 2 Drawing Sheets

METHOD FOR PROVIDING SOLIDS-FREE PRODUCTION FROM HEAVY OIL RESERVOIRS

FIELD OF THE INVENTION

This invention relates to a process for extracting hydrocarbons from the earth. More particularly, this invention relates to a method for recovering especially solids-free hydrocarbons e.g., bitumen from a subterranean formation using at least two wells.

BACKGROUND OF THE INVENTION

In many areas of the world, there are large deposits of viscous petroleum, such as the Athabasca and Peace River regions in Canada, the Jobo region in Venezuela and the Edna and Sisquoc regions in California. These deposits are generally called tar sand deposits due to the high viscosity of the hydrocarbons which they contain and may extend for many miles and occur in varying thickness of up to more than 300 feet. Although tar sands may lie at or near the earth's surface, generally they are located under substantial overburden which may be as great as several thousand feet thick. Tar sands located at these depths constitute some of the world's largest presently known petroleum deposits.

Tar sands contain a viscous hydrocarbon material, commonly referred to as bitumen, in an amount which ranges from about 5 to about 20 percent by weight. Bitumen is usually immobile at typical reservoir temperatures. For example, at reservoir temperatures of about 48° F., bitumen is immobile, having a viscosity frequently exceeding several thousand poises. At higher temperataures, such as temperatures exceeding 200° F., bitumen generally becomes mobile with a viscosity of less than 345 centipoises.

Since most tar sand deposits are too deep to be mined economically, a serious need exists for an in situ recovery process wherein the bitumen is separated from the sand in the formation and recovered through production means e.g. a well drilled into the deposit.

In situ recovery processes known in the art include emulsification drive processes, thermal techniques (such as fire flooding), in situ combustion, steam flooding and combinations of these processes.

Any in situ recovery process must accomplish two functions. First, the viscosity of the bitumen must be reduced to a sufficiently low level to fluidize the bitumen under the prevailing conditions. Secondly, sufficient driving energy must be applied to treated bitumen thereby inducing it to move through the formation to a well or other means for transporting it to the earth's surface.

As previously noted, among the various methods that have been proposed for recovering bitumen in tar sand deposits are heating techniques. Because steam is generally the most economical and efficient thermal energy agent, it is clearly the most widely employed.

Several steam injection processes have been suggested for heating the bitumen. One method involves a steam stimulation technique, commonly called the "huff and puff" process. In such a process, steam is injected into a well for a certain period of time. The well is then shut in to permit the steam to heat the oil. Subsequently, formation fluids, including bitumen, water and steam, are produced from the well along with sand. Production is later terminated and steam injection is preferably resumed for a further period. Steam injection and production are alternated for as many cycles as desired. A principle drawback to the "huff and puff" technique is that it does not heat the bulk of the oil in the reservoir and consequently reduces the oil recovery.

Another problem with steam drive is that the driving force of the steam flooding technique is ultimately lost when breakthrough occurs at the production well. Steam breakthrough occurs when the steam front advances to a production well and steam pressure is largely dissipated through the production well. Fluid breakthrough causes a loss of steam driving pressure characterized by a marked diminution in the efficiency of the process. After steam breakthrough the usual practice, as suggested in U.S. Pat. No. 3,367,419 (Lookeren) and U.S. Pat. No. 3,354,954 (Buxton), is to produce without steam drive until further steam injection is necessitated or production terminated. These patents are incorporated herein by reference.

U.S. Pat. No. 3,259,186 (Dietz), for example, appears to have an early teaching for conventional "huff and puff". The patent discloses a method for recovering viscous oil from subterranean formations by simultaneously injecting steam into an injection well to heat the formation. Formation fluids are then produced from the injection well. After several cycles, steam drive can be established if several adjacent injection wells have been used by injecting steam into one injection well while using another for production. U.S. Pat. No. 3,280,909 (Closmann et al) discloses a conventional steam drive comprising steam injection to produce interconnecting fractures, but insufficient to produce oil, followed by steam drive at conventional pressures and rates. Thus, the heating and driving phases are entirely distinct. These patents are incorporated herein by reference.

Steam also releases unconsolidated formation sand grains as it lowers the viscosity of the formation oil. Formation oil, thus released, will be free to move with the oil of reduced viscosity as the formation is produced.

Therefore, what is needed is an efficient method to produce the formation, control formation fines, and still allow steam contact with oil in place in the formation.

SUMMARY OF THE INVENTION

This invention is directed to a method for producing viscous substantially solids-free hydrocarbonaceous fluids from an unconsolidated formation or reservoir.. Initially, at least two spaced part first and second wells are drilled into a lower producive interval of the formation. Afterwards, these wells are hydraulically fractured with a fracturing fluid containing a proppant so as to create and prop fractures in the formation. Thereafter, a pre-determined volume of stream is injected into the first well in an amount sufficient to soften the viscous fluid and reduce the viscosity of said fluid adjacent to a fracture face. The first well is then produced at a rate sufficient to allow formation fines to build up on the propped fracture face communicating with said first well, thereby, resulting in a filter which is sufficient to substantially remove formation fines from the viscous hydrocarbonaceous fluid.

Once a desired amount of viscous fluid has been produced from the first well, it is shut in and a pre-determined amount of steam is injected into the second well. Steam injection into the second well is then ceased and hydrocarbonaceous fluids are produced from the second well at a rate sufficient to allow formation fines to build up on a fracture face communicating with said second well. The build up of formation fines on the fracture face results in a filter screen sufficient to remove formation fines from the hydrocarbonaceous fluids which are produced to the surface.

Subsequently, a second volume of steam is injected into the second well and substantially solids-free hydrocarbonaceous fluids are produced from the first well. Thereafter, the second well is shut in and a pre-determined volume of steam is injected into the first well. Thereafter the second well is opened and substantially solids-free oil of reduced viscosity is produced to the surface. Steam injection is continued into the first well until steam breaks through to the second well.

Once steam has broken through from the first well into the second well, both wells are shut-in and the lower productive interval is isolated by packers containing knock-out plugs. After the production packers are in place, both wells are perforated at an upper productive interval. Fracturing is initiated in both wells and the steps above which were conducted in the lower interval are repeated in the upper interval. However, steam breakthrough does not occur at the upper interval.

Subsequently, both wells are re-entered and a production string is directed through the production packer so as to be in fluid communication with the lower productive interval. Steam is then injected through the production string where it enters the lower productive interval. Injection of steam into the lower productive interval causes the upper interval to heat up via a "hot plate" effect. After the upper interval has heated up, substantially solids-free hydrocarbonaceous fluids of reduced viscosity are produced from the upper productive interval to the surface.

It is therefore an object of this invention to form a thermally stable in situ formation fines screen so as to filter fines from the produced oil.

It is another object of this invention to provide for a method to throughly treat a formation surrounding a well with high temperature steam.

It is yet another object of this invention to provide for an oscillatory steam treatment procedure between a first and second well so as to provide for a more efficient sweep of the payzone with steam.

It is yet a still further object of this invention to circulate steam down the tubing of the well while producing thin oil from the well's annulus so as to provide for a "hot plate" effect in the lower part of a reservoir.

It is an even still yet further object of this invention to accumulate gas/or steam produced from an upper interval of a formation so as easily separate them at the surface and subsequently re-inject steam into the formation.

It is a still yet even further ojection of this invention to provide for a steam injection process wherein the steam route can be reversed i.e., steam can be directed down the annulus of the well and oil produced up the tubing so as to prolong oil recovery from a viscous oil-containing reservoir.

DESCRIPTION OF THE PREFERRED EMBODIMENTS

In the practice of this invention two wells are drilled into a formation. The wells are cased and then selectively perforated over a one to two foot interval in the lower productive interval of the formation. Due to the shallow depth of the tar sand or other viscous hydrocarbon containing formation, the nature of the soft formation rock makes it more probable that horizonal fractures will be produced in the formation during hydraulic fracturing. A hydraulic fracturing technique is discussed in U.S. Pat. No. 4,067,389 which issued to Savins on Jan. 10, 1978. Another method for initiating hydraulic fracturing is disclosed by Medlin et al. in U.S. Pat. No. 4,378,849 which issued on Apr. 5, 1983. Both patents are hereby incorporated by reference herein. As is known by to those skilled in the art, in order to initiate hydraulic fracturing in a formation, the hydraulic pressure applied must exceed the formation pressures in order to cause a fracture to form. The fracture which forms will generally run perpendicular to the least principle stress in the formation or reservoir.

The fracturing fluid which is used to hydraulically fracture the formation comprises a viscous gel. The viscous gel can include a water-base hydroxypropyl guar (HPG), hydroxyethyl cellulose (HEC), carboxymethylhydroxyethyl cellulose (CMHEC), guar or oil-based diesel oil, and kerosene gelled with aluminum phosphate esters (e.g., Halliburton Services MY-T Oil TM II, Dowell/Schlumberger's YF-GO TM B. J. Titan's ALLOFRAC TM, and The Western Company of North America's MAXI-O TM gel.

The proppant concentration in the viscous gel should be in concentration of about 10 to about 18 pounds/gallons and can include a silicon carbide, silicon nitride or garnet proppant. These proppants are particularly preferred since they endure the high temperature effects of steam. A hydraulic fracturing method employing special sand control is disclosed by Stowe et al. in U.S. Pat. No. 4,549,608 which issued on Oct. 29, 1985. This patent is hereby incorporated by reference herein. Silicon carbide or silicon nitride which can be used herein should be of a size of from about 20 to about 100 U.S. Sieve. This fused refractory material should have a Mohs hardness of about 9. Both silicon carbide and silicon nitride have excellent thermal conductivity. Silicon nitride, for example, has a thermal conductivity of about 10.83 BTU/in sq. ft/hr./°F. at 400° to about 2400° F. A suitable silicon carbide material is sold under the Crystolon ® trademark and can be purchased from Norton Company, Metals Division, Newton, Mass. A suitable silicon nitride material can be also purchased from Norton Company. The size of the proppant used herein should be based on the particle size distribution of the formation fines so as to restrict formation fines movement into the propped fracture by the formation of a fines screen.

Figure 1:
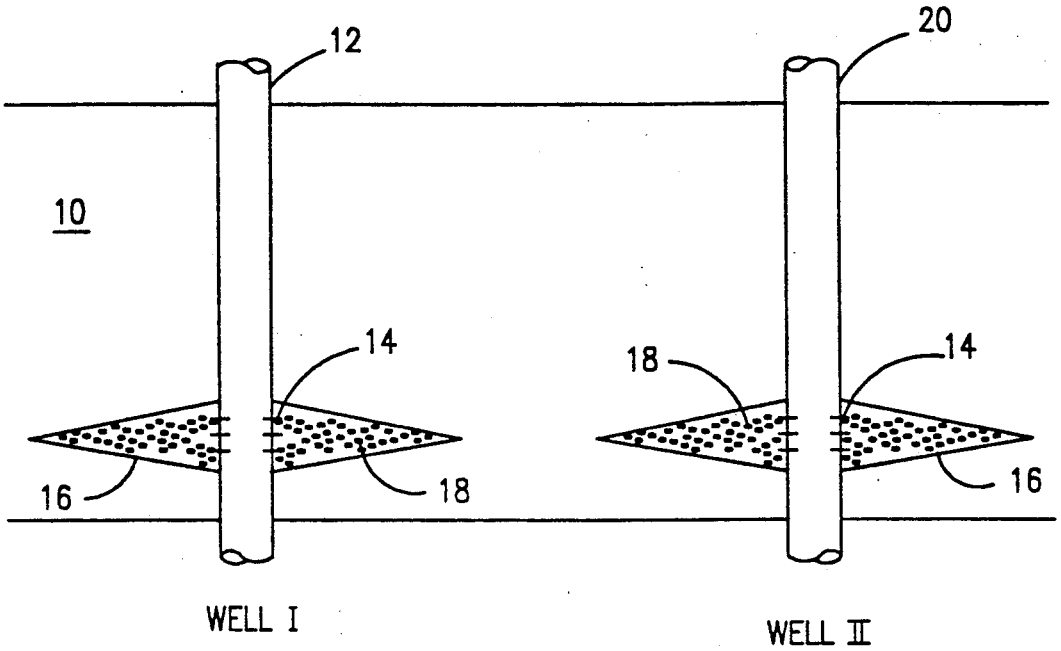
FIG. 1 is a schematic representation of a first and second well showing a fracture in the formation, which fracture has a fluid and proppant therein.
Figure 2:
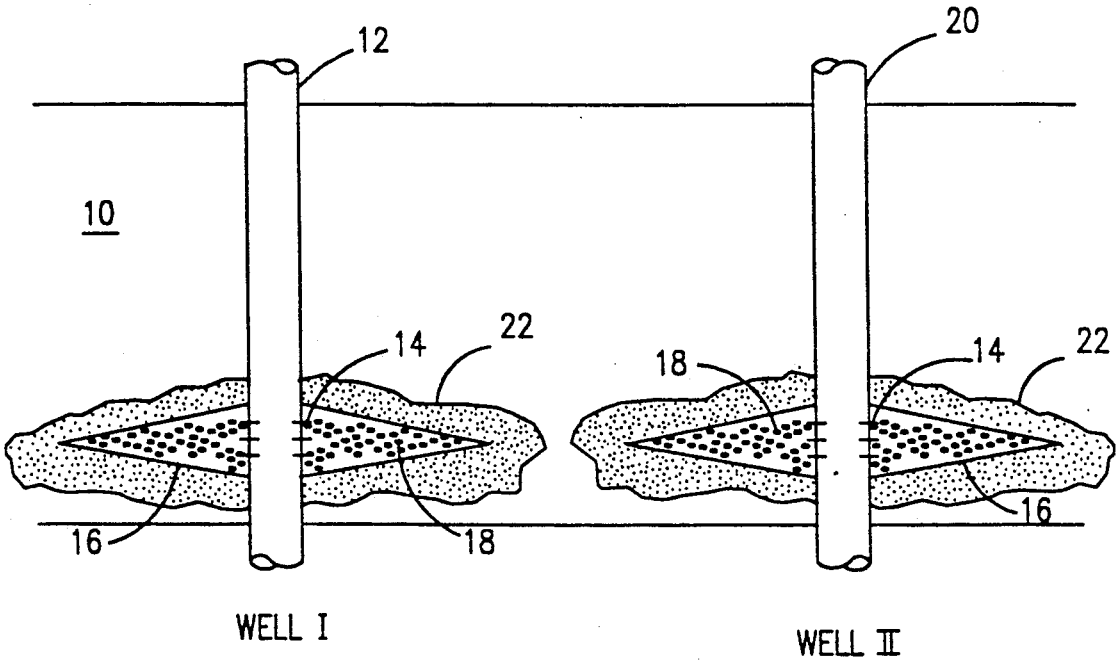
FIG. 2 is a schematic representation which shows a first and second well penetrating a formation where said formation has been fractured and the fracture propped with a fracturing fluid containing a proppant sufficient to form a fines screen at the face of the fracture.
Figure 3:
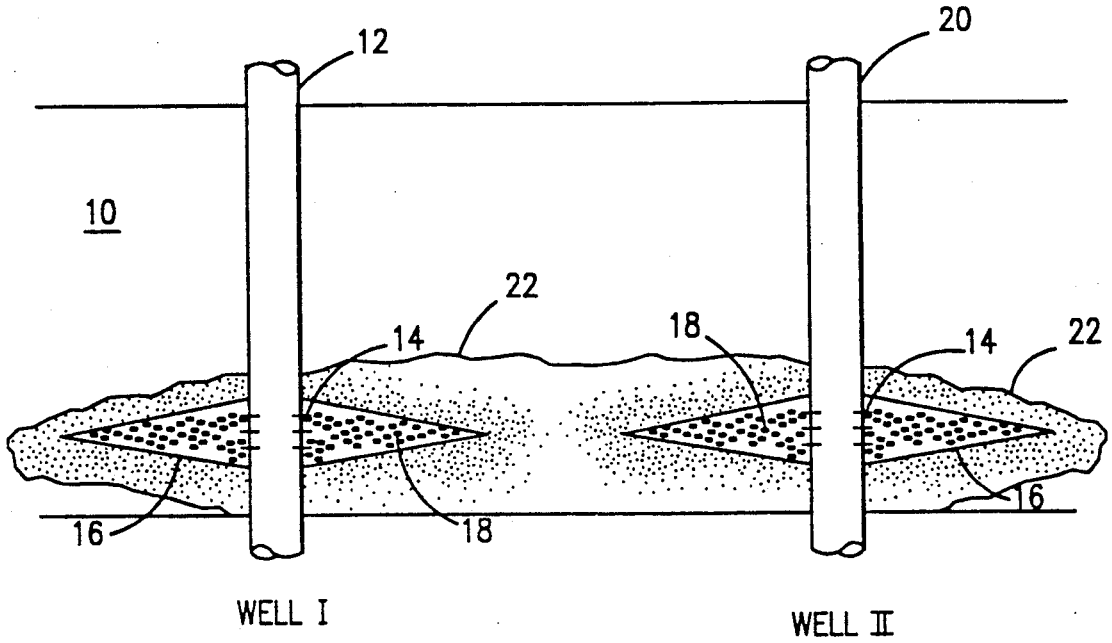
FIG. 3 is a schematic representation showing steam entering into a formation from a first and second well.

As is shown in FIG. 1, proppant 18 has entered fractures 16 in formation 10 via perforations 14. Wells 12 and 20 are similarly fractured at a lower interval of formation 10. After fracturing both wells, a pre-determined volume of steam is injected into well 12 where it enters fracture 16 to soften tar sand and to reduce the viscosity of oil adjacent to the fracture face. After injecting steam into well 12 for a desired period of time, well 12 is shut in and carefully produced to allow formation fines 22 to build up on the resulting fracture face as shown schematically in FIG. 2. As in shown in FIG. 2, fines 22 continue to build up so as to make a filter screen which filters formation fines from the produced oil. After producing well 12 for the desired amount of time, well 12 is shut-in and steam injection is commensed in well 20. Steam is injected into well 20 for a desired period of time and subsequently steam injection is ceased. Well 20 is then shut-in and afterwards oil of a reduced viscosity is carefully produced to the surface from well 20 to allow formation fines 22 to build up on the resultant fracture face as shown schematically in FIG. 2. A second volume of steam is then injected into well 20 and well 12 is then open to production again. Subsequently shut-in and another volume of steam is injected into well 12. Thereafter, well 20 is opened and oil of reduced viscosity which is substantially solids-free is produced to the surface. Steam injection is continued into well 12 until steam breaks through to well 20 as is shown in FIG. 3.

Figure 4:
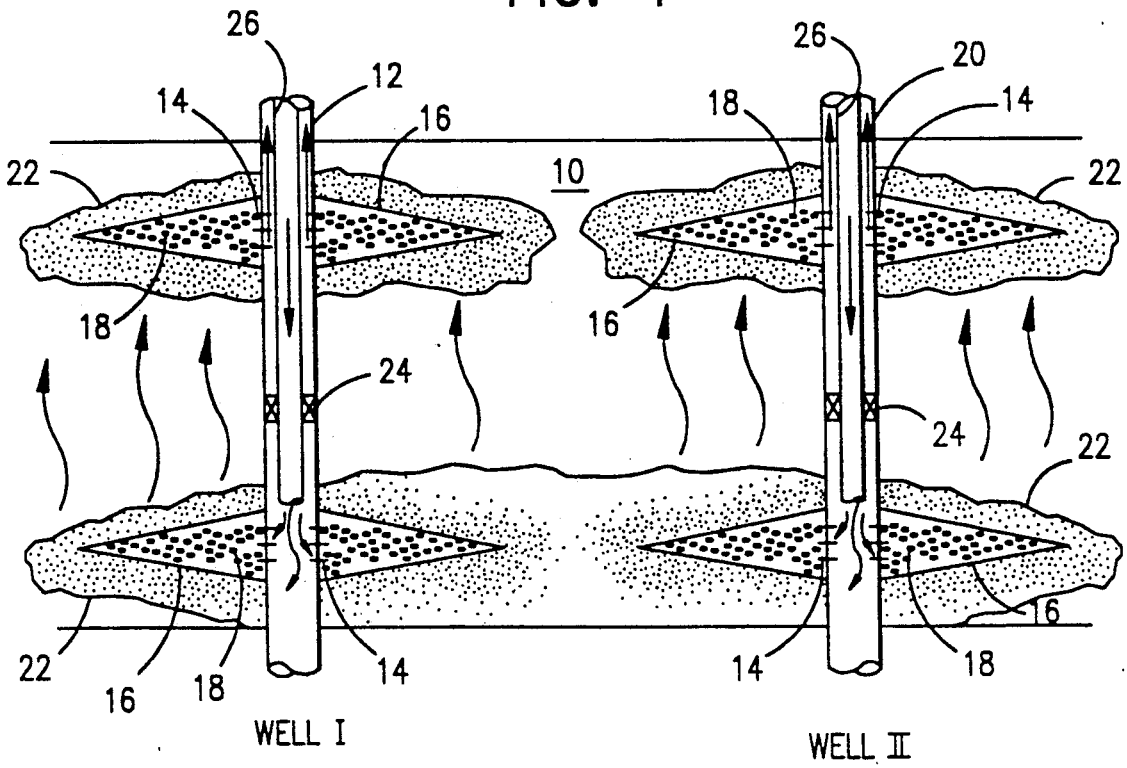
FIG. 4 is a schematic representation of a first and second well penetrating a formation and which formation contains fractures in a lower and upper interval where steam is directed through a tube in said well into the lower interval so as to provide a "hot plate" effect.

Once steam has broken through from well 12 into well 20, both wells are shut-in and the lower productive interval of for the formation is isolated by packer 24 containing knock-out plugs therein as is shown in FIG. 4. Once production packers 24 are in place, wells 12 and 20 are perforated at an upper productive interval of formation 10 and hydraulic fracturing is initiated in the upper productive interval as was mentioned above relative to the lower productive interval.

As mentioned previously, wells 12 and well 20 are perforated over a one to two foot interval of an upper producing interval of formation 10. Both wells are hydraulically fractured as was previously done with a viscous gell containing a proppant therein so as to withdstand the effects of high temperature steam injection. A proppant of similar particle size is used in the fractures which are created in upper interval of formation 10 as were used in the lower interval of said formation, so as to restrict formation fines movement into the prop fracture. Subsequently, a pre-determined volume of steam is injected into the fractures which have been created in well 12 so as to soften tar sand and reduce the viscosity of the oil adjacent to the fractured face in said upper formation. Because the upper formation interval has been isolated by production packer 24, steam can not enter into the lower interval of said formation.

Well 12 is then carefully produced so as to allow formation fines to build on the fracture face in the upper interval of formation 10 as is shown in FIG. 4. This results in an improved filter screen so as filter formation fines from the oil which is produced from the upper interval. Well 12 is then shut-in and steam injection is commenced into well 20 where steam enters into the upper productive interval since perforation packer 24 prevents steam entry into the lower interval of said formation. A volume of steam is then injected into well 12 for a desired period of time and subsequently steam injection is ceased and well 20 has a substantially solids-free oil produced to the surface. Substantially solids-free oil of reduced viscosity is obtained because it is carefully produced to the surface from well 20 to allow formation fines 22 to build up on the resultant fracture face as shown schematically in FIGS. 2 and 3. Afterwards, a second volume of steam is injected into well 20 and well 12 is opened to production again. Thereafter, well 20 is shut-in and a volume of steam again injected into well 12 where it enters the upper interval of formation 10. Subsequently, well 20 is opened and a substantially solids-free oil of reduced viscosity is produced to the surface. Once the cyclic oscillatory steam injection steps have been completed to the extent desired, wells 12 and 20 are shut-in.

Wells 12 and 20 are re-entered and production string 26 is directed through production packer 24 in each well so as to be in fluid communication with the lower productive interval of formation 10. As is shown in FIG. 4, steam is injected into wells 12 and 20 through production string 26 so as to cause the steam to enter into the lower productive interval of formation 10. Steam injected into the lower interval of formation 10, heats up the upper interval of said formation, thereby creating a "hot plate" effect in the reservoir. As the upper productive interval of formation 10 is heated up, substantially solids-free hydrocarbonaceous fluids of reduced viscosity enter perforations of wells 12 and 20 from the upper productive interval and are produced to the surface. Utilization of this method provides for prolonged recovery of substantially solids-free oil of reduced viscosity from a reservoir or formation.

Although the present invention has been described with preferred embodiments, it is to be understood that modifications and variations may be resorted to without departing from the spirit and scope of this invention, and &:hose skilled in the art will readily understand. Such modifications and variations are considered to be within the purview and scope of the appended claims.

What is claimed is:

1. A method for producing viscous substantially solids free hydrocarbonaceous fluids from an unconsolidated formation or reservoir comprising:

(a) drilling into said reservoir first and second spaced apart wells into a lower productive interval of said formation;

(b) perforating both wells in the lower productive interval;

(c) fracturing hydraulically said wells at the lower productive interval with a viscous fracturing fluid containing a proppant therein so as to prop a created fracture;

(d) injecting a pre-determined volume of steam into said first well in an amount sufficient to soften said viscous fluid and lower the viscosity of said fluid adjacent a fractured face;

(e) producing the first well at a rate sufficient to allow formation fines to build up on a fracture face communicating with said first well thereby resulting in a filter screen sufficient to substantially remove formation fines from the hydrocarbonaceous fluids;

(f) shutting in said first well while injecting steam in a predetermined amount in said second well;

(g) shutting in the second well and thereafter producing hydrocarbonaceous fluids from said second well at a rate sufficient to allow formation fines to build up on a fracture face communicating with said second well which results in a filter screen sufficient to remove formation fines from produced hydrocarbonaceous fluids; and (h) injecting a second volume of steam into the second well and producing a substantially solids-free hydrocarbonaceous fluid from the first well.

2. The method as recited in claim 1 where after step (h) the wells are alternatively produced and injected with steam until such time as a desired amount of substantially solids-free hydrocarbonaceous fluids are removed from the formation.

3. The method as recited in claim 1 where the wells are cased and selectively perforated at a one to two foot interval so as to communicate fluidly with a productive interval of the formation.

4. The method as recited in claim 1 where the unconsolidated formation comprises tar sand.

5. The method as recited in claim 1 where in step (c) the proppant size is determined by the particle size distribution of formation fines so as to restrict fines movement into a propped fracture.

6. The method as recited in claim 1 where in step (b) the proppant size is determined by the particle size distribution of formation fines so as to restrict fines movement into a propped fracture.

7. A method for producing viscous substantially solids-free hydrocarbonaceous fluids from an unconsolidated formation or reservoir comprising:

(a) drilling into said formation first and second spaced apart wells into a lower productive interval of said formation;

(b) perforating both wells in the lower productive interval;

(c) fracturing hydraulically said wells at the lower productive interval with a viscous fracturing fluid containing a proppant therein so as to prop a created fracture and form a fines screen;

(d) injecting a pre-determined volume of steam into said first well in an amount sufficient to soften said viscous fluid and lower the viscosity of said fluid adjacent a fracture face;

(e) producing the first well at a rate sufficient to allow formation fines to build up on a fracture face communicating with said first well thereby resulting in a filter screen sufficient to substantially remove formation fines from the hydrocarbonaceous fluids;

(f) shutting in said first well while injecting steam in a predetermined amount in said second well;

(g) shutting in the second well and thereafter producing hydrocarbonaceous fluids from said second well at a rate sufficient to allow formation fines to build up on a fracture face communicating with said second well which results in a filter screen sufficient to remove formation fines from produced hydrocarbonaceous fluids;

(h) shutting in the second well and injecting a predetermined volume of steam into the first well;

(i) opening said second well and producing hydrocarbonaceous fluids therefrom; and j) continuing the injection of steam into the first well until steam breakthrough at the second well.

8. The method as recited in claim 7 where the wells are cased and selectedly perforated at a one to two foot interval so as to communicate fluidly with a productive interval of the formation.

9. The method as recited in claim 7 where the unconsolidated formation comprises tar sand.

10. A method for producing viscous substantially solids-free hydrocarbonaceous fluids from an unconsolidated formation or reservoir comprising:

(a) drilling into said reservoir first and second spaced apart wells into a lower productive interval of said formation;

(b) perforating both wells in the lower productive interval;

(c) fracturing hydraulically said wells at said productive interval with a viscous fracturing fluid containing a proppant therein so as to prop a created fracture and form a fines screen;

(d) injecting a pre-determined volume of steam into said first well in an amount sufficient to soften said viscous fluid and lower the viscosity of said fluid adjacent a fracture face;

(e) producing the first well at a rate sufficient to allow formation fines to build up on a fracture face communicating with said first well thereby resulting in a filter screen sufficient to substantially remove formation fines from the hydrocarbonaceous fluids;

(f) shutting in said first well while injecting steam in a predetermined amount in said second well;

(g) shutting in the second well and thereafter producing hydrocarbonaceous fluids from said second well at a rate sufficient to allow formation fines to build up on a fracture face communicating with said second well which results in a filter screen sufficient to remove formation fines from produced hydrocarbonaceous fluids;

(h) injecting a second volume of steam into the second well and producing a substantially fines free hydrocarbonaceous fluids from the first well;

(i) shutting in the second well and injecting a predetermined volume of steam into the first well;

(j) opening said second well and producing hydrocarbonaceous fluids therefrom;

(k) continuing the injection of steam into the first well until steam breakthrough at the second well;

(l) shutting in the first and second wells and thereafter isolating the lower perforated interval with production packers which have "knock-out" plugs therein;

(m) perforating both wells at an upper productive interval of said formation so as to enable fluid communication between the first and second wells;

(n) repeating steps (c) through (j);

(o) shutting in thereafter said first and second wells;

(p) re-entering said first and second wells;

(g) running in a production string through the packers in said first and second wells so as to allow fluid communication with said lower interval of the formation; and (r) circulating steam down through said production strings in both wells which string enters said lower interval thereby causing the temperature in the upper interval to rise, making substantially solids-free hydrocarbonaceous fluids to flow through both of said wells at the upper interval, and producing said hydrocarbonaceous fluids to the surface.

* * * * *